US005094274A

United States Patent [19]

Bucher et al.

[11] Patent Number: 5,094,274

[45] Date of Patent: Mar. 10, 1992

[54] HEDDLE FRAME CARRIER FOR INTERCHANGEABLE HEDDLE FRAMES

[75] Inventors: Robert Bucher, Frick, Switzerland; Helmut Macho, Constance, Fed. Rep. of Germany

[73] Assignee: Sulzer Brothers Limited, Winterthur, Switzerland

[21] Appl. No.: 430,722

[22] Filed: Nov. 2, 1989

[30] Foreign Application Priority Data

Nov. 16, 1988 [CH] Switzerland ..... 04254/88

[51] Int. Cl.[5] ..... D03C 9/06

[52] U.S. Cl. ..... 139/82; 139/91

[58] Field of Search ..... 49/463, 381-394, 49/465; 139/82, 91, 92, 57, 87, 88; 248/222.1; 40/611-618, 620, 489, 490, 491

[56] References Cited

U.S. PATENT DOCUMENTS

| | | | |
|---|---|---|---|
| 381,342 | 4/1888 | De Land | 40/611 |
| 889,655 | 6/1908 | Briggs | 139/92 |
| 2,131,679 | 9/1938 | Ulrich | 139/57 |
| 2,336,954 | 12/1943 | Osteen | 139/92 |
| 3,914,890 | 10/1975 | Behlen, Jr. | 40/611 |
| 3,961,649 | 6/1976 | Palau | 139/82 |
| 4,481,979 | 11/1984 | Mizuguchi | 139/82 |
| 4,603,713 | 8/1986 | Takada | 139/82 |
| 4,877,060 | 10/1989 | Froment et al. | 139/82 |

FOREIGN PATENT DOCUMENTS

| | | |
|---|---|---|
| 1166108 | 3/1964 | Fed. Rep. of Germany . |
| 0613527 | 11/1925 | France . |
| 48-28049 | 8/1973 | Japan . |
| 48-28050 | 8/1973 | Japan . |

*Primary Examiner*—Andrew M. Falik
*Attorney, Agent, or Firm*—Kenyon & Kenyon

[57] ABSTRACT

The heddle frame carrier has a horizontal beam interconnecting two vertical arms each of which has a reduced zone operative as a pivot joint. For heddle frame changing, the arms can be hinged apart from one another with the locking members at the upper ends pulled away outwardly from the top beam of the heddle frame. Shaft retaining elements are therefore provided which provide secure and reliable retention of the heddle frame without clamping forces being exerted thereon and which enable heddle frame changing to be carried out very rapidly without the use of any tool.

11 Claims, 2 Drawing Sheets

HEDDLE FRAME CARRIER FOR INTERCHANGEABLE HEDDLE FRAMES

This invention relates to a heddle frame carrier for a loom. More particularly, this invention relates to a heddle frame carrier for retaining an interchangeable heddle frame in a loom.

As is known, various types of heddle frame carriers have been employed for the mounting of a heddle frame in a loom. For example, U.S. Pat. No. 2,131,679 describes a harness carrier which is U-shaped in elevation and channel-shaped in cross-section for seating a harness therein. In addition, spring actuated latches are provided on the upper ends of side arms of the harness carrier to engage the end members of the harness and hold the harness in the carrier. The side arms of the carrier also have external vertically elongated guide slots for receiving the inner ends of guide pins against which the outer edges of the harness carrier ride as the carrier reciprocates vertically. In order to unlock or release the harness, the latches are biased against the springs so as to be moved away from the harness. One advantage of this arrangement is that harness changing can be proceed without the use of tools and rapidly with a consequent reduction in loom down time. However, the use of displaceable latches and springs is a disadvantage in that such is a complex and, therefore, expensive construction. Further, the springs are helical springs which may work improperly if they become covered with dust and fibers over a period of time.

Other heddle frame carriers are also known, for example from Japanese published patent application 48-28049 wherein the heddle frame is fitted into vertical grooves of a carrier and clamped in place by a clamping tool. Japanese publication 48-28049 also describes a carrier wherein a heddle frame is locked in place by means of pins at the upper and lower portions of the carrier frame and by cam-like portions which are pivoted about the pins by levers. However, in both cases, a complex locking arrangement is required in order to lock a heddle frame in the carrier.

German Patent 1,166,108 describes a heddle frame which carries a pair of oppositely guided projections on opposite ends for interfitting with a frame and a toggle-like locking arrangement for securing the heddle frame to a drive. There is no heddle frame carrier employed.

French Patent 613,527 describes a conventional heddle frame which is guided in a mounting arrangement without use of any carrier.

Accordingly, it is an object of the invention to provide a heddle frame carrier which is adapted to provide satisfactorily firm retention of a heddle frame.

It is another object of the invention to provide a heddle frame carrier for heddle frames of simple construction which are adapted to withstand only reduced stressing.

It is another object of the invention to provide a heddle frame carrier of simple rugged construction.

It is another object of the invention to be able to change heddle frames rapidly without the use of tools in a heddle frame carrier.

Briefly, the invention provides a heddle frame carrier for retaining an interchangeable heddle frame in a loom. In one embodiment, the carrier is formed of at least a pair of parallel vertical arms for slidably receiving a heddle frame therebetween with each arm sized to permit pivoting of an upper end away from the other arm.

In addition, a locking element is disposed on the upper end of each arm for movement therewith between a locking position to engage over a heddle frame and a release position to permit vertical movement of the heddle frame thereby. In this embodiment, each arm has a reduced zone at an intermediate point to form a pivot joint thereat. Each locking element also has a horizontal abutment surface for engaging over a heddle frame and a pair of vertical webs on opposite sides of the abutment surface in order to retain the heddle frame therebetween against lateral movement.

The pair of parallel arms of the carrier may be interconnected by means of a horizontal beam which also serves to support a heddle frame thereon.

A pair of securing jaws may also be provided on the horizontal beam for gripping a heddle frame in order to prevent lateral movement of the heddle frame relative to the beam. In addition, each arm may be provided with a vertical prolongation extending below the horizontal beam.

In another embodiment, a pair of arms may be disposed in offset relation to each other in order to receive one side of a heddle frame therebetween. In each case, each arm has a locking element with a horizontal abutment surface for engaging over the heddle frame.

In another embodiment, a pair of vertical arms are spaced from each other and each is provided provided with a horizontally disposed bearing surface to support one end of a heddle frame thereon opposite a respective locking element. In each case, the locking element is disposed on an upper end of an arm for pivoting about a vertical axis between a locking position to engage over a heddle frame and a release position to permit vertical movement of the heddle frame thereby.

In still another embodiment, a slider may be mounted on at least one of two parallel arms for movement between a locking position to engage over a heddle frame and a release position to permit vertical movement of the heddle frame thereby. In this case, the slider includes a vertical stop for abutting a side of an arm while a spring biases the slider into the locking position with the stop abutting against the arm.

These and other objects and advantages of the invention will become more apparent from the following detailed description taken in conjunction with the accompanying drawings wherein:

FIG. 1 diagrammatically illustrates a heddle frame carrier constructed in accordance with the invention mounting a carrier within a loom.

Figure 1:
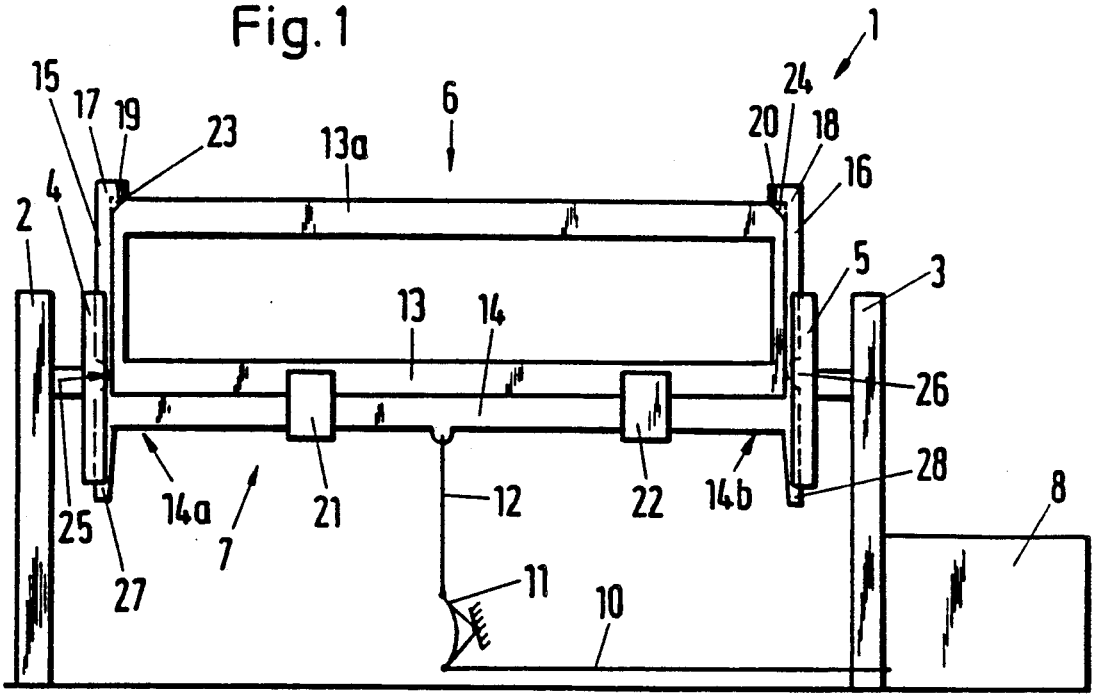

Referring to FIG. 1, a loom, for example of conventional structure, is provided with a pair of side walls 2, 3 on which guides 4, 5 are mounted for guiding a vertically reciprocating heddle frame 6. As indicated, the heddle frame 6 is introduced into a heddle frame carrier 7 which is connected to a shedding motion 8 which provides a driving motion by way of a positive heddle-lifting device having known transmission elements 10, 11, 12.

As indicated, the heddle frame 6 has a rectangular shape defined in part by a pair of horizontal spaced apart beams 13, 13*a*. .

The carrier 7 is formed of a pair of vertical arms 15, 16 which are interconnected by a horizontal beam 14 which also receives the lower beam 13 of the heddle frame 6 thereon in supporting relation. The arms 15, 16 are of a length and width to slidably receive the heddle frame 6 therebetween and each arm 15, 16 is sized to permit pivoting of an upper end of one arm away from the other arm. In this respect, each arm 15, 16 has a reduced zone 25, 26 at an intermediate point to form a pivot joint thereat. In addition, each arm has a locking element 17, 18, for example in the form of a nib or the like, for movement with the arm between a locking position, as shown, to engage over atop of the heddle frame 6 and a release position (not shown) to permit vertical movement of the heddle frame 6 thereby. In this respect, each locking element 17, 18 has a horizontal abutment surface 19, 20 for engaging over the heddle frame 6 at the corners of the top beam 13*a* so that the heddle frame 6 is disposed without clearance both at least between the beam ends 14*a*, 14*b* (effective as support elements) and the surfaces 19, 20.

In order to provide for lateral restraint of the heddle frame 6 within the carrier 7, a pair of securing jaws 21, 22 are disposed at the front and rear of the horizontal beam 14 of the carrier 7 to act as a clip or gripper or the like to prevent lateral movement of the heddle frame 6 relative to the beam 14. In addition, a pair of vertical webs 23, 24 are provided on opposite sides of the respective abutment surfaces 19, 20 of the locking elements 17, 18 in order to retain the heddle frame laterally therebetween.

The reduced zones 25, 26 of the respective vertical arms 15, 16 enable the arms 15, 16 to pivot resilient outwardly around axes perpendicular to the plane of the heddle frame movement so as to bring the locking elements 17, 18 into the release position. Also, the arms 15, 16 have vertical prolongations 27, 28 which amplify the channel-shaped cross-section of the frame 7 to form a U-shaped configuration. In cooperation with corresponding prolonged guides 5, 6 of the loom 1, this ensures improved lateral guiding of the heddle frame carrier 7.

During operation, a driving motion is transmitted from the shedding motion 8 via a rod 10, a toggle type transmission element and a vertical rod 12 to the horizontal beam 14 of the carrier 7. While such a simple lifting arrangement, of itself, cannot provide the heddle frame 6 with directional stability during movement, as is the case, for example, with conventional heddle frame lifters engaging two bottom corners of the heddle frame, improved guidance is provided by the prolongations 27, 28 of the carrier 7 so as to avoid any risk of the carrier 7 tilting.

The vertical reciprocation of the heddle frame carrier 7 produces vertical reaction forces of the heddle frame 6 which act on the beam 14 and by way of the abutment surfaces 19, 20 on the locking elements 17, 18. Since the abutment surface 19, 20 are horizontal, the locking elements 17, 18 experience only vertical forces and therefore remain unstressed in the release direction. Shaft locking therefore remains unaffected by the operation of the loom and there is no need to secure the sliding connection between the heddle frame 6 and the locking elements 17, 18. Since the locking elements 17, 18 are displaceable only horizontally and the heddle frame 6 is firmly supported on the horizontal beam 14, the only relative movement between the heddle frame 6 and the carrier 7 is a horizontal one. Consequently, the speed at which the loom 1 operates, with the vertical reaction forces, does not affect the close fit of the heddle frame 6 in the carrier 7.

To change the heddle frame 6, the guides 4, 5 are drawn back outwardly into the sides 2, 3 of the loom 1, so that the vertical arms 15, 16 can be pivoted around their reduced zones 25, 26, which define pivot joints. Thus, that the locking elements 17, 18 are drawn away from the top beam 13*a* of the heddle frame 6 and outwardly into the release position. The resilient reduced zones 25, 26 have some spring force effective in the locking direction which boosts a close fit of the locked heddle frame 6; however, because of the construction of the locking elements 17, 18, any stressing in the release direction when the loom is in operation is absent so that a reduced spring force suffices and so the heddle frame 6 can readily released be manually.

Figure 2:
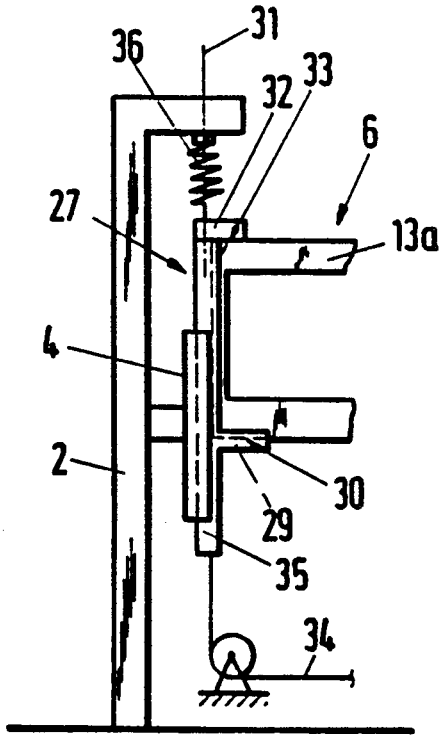
FIG. 2 illustrates a modified heddle frame carrier in accordance with the invention.

Referring to FIG. 2, wherein like reference characters indicate like parts as above, the heddle frame carrier may be formed of a pair of vertical arms 26 (only one of which is shown) which are not interconnected. As indicated, each vertical arm is guided in a respective guide 4 on the loom side 2 and face one another so as to engage a lateral zone of the heddle frame 6. In addition, each arm 27 has a horizontally disposed support element 29 having a rigid bearing surface 30 for receiving the heddle frame 6 thereon. In addition, a locking element 32 is mounted on the upper end of the arm 27 with a horizontally disposed surface 33 for engaging over and against the top beam 13*a* of the heddle frame 6. As indicated, the locking element 32 is pivotable about a vertical axis 31 so as to move from a locking position as viewed over the heddle frame 6 into a release position to permit movement of the heddle frame 6 out of the arm 27. As shown, a heddle frame lifter in the form of a negative heddle frame drive acts in known manner by way of a pull cable 34 on an extension 35 of the vertical arm 27 in the pull-down direction and by way of a return spring 36 in the pull-up direction. This arrangement enables the heddle frame to be released by the locking elements 32 pivoting around the respective axis 31 out of the plane of heddle frame movement. The arrangement has the advantage of a substantial weight saving in view of the absence of a horizontal beam between the vertical arms. At the same time, the arrangement meets all of the requirements as regard heddle frame retention and heddle frame changing while being of very simple construction.

Figure 3:
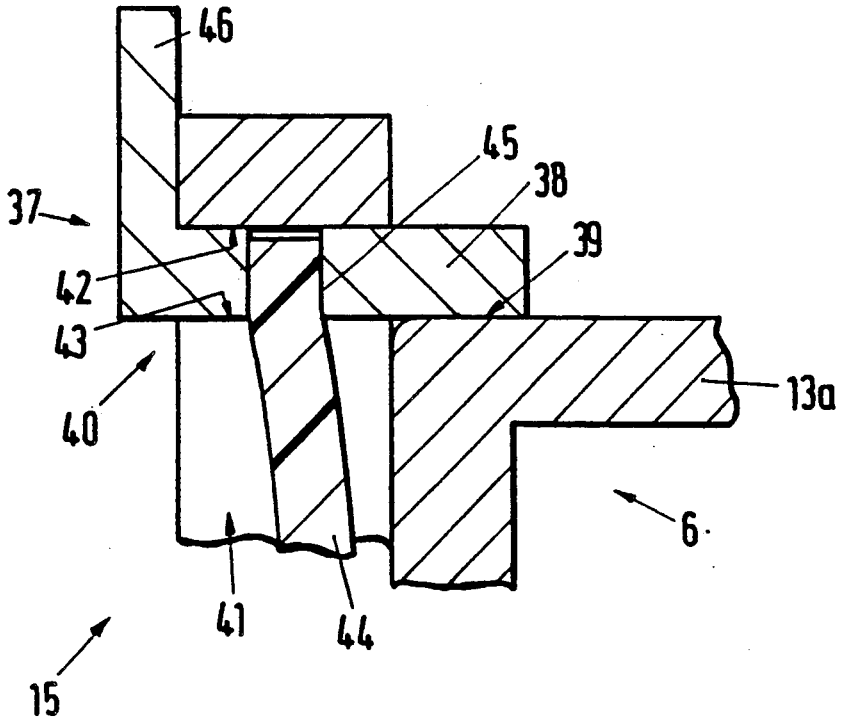
FIG. 3 illustrates a cross sectional view of a further modified heddle frame carrier constructed in accordance with the invention.

Referring to FIG. 3, which shows the top end 37 of one vertical arm 15, the locking element may be in the form of a slider 38 which is operative to lock the heddle frame 6 in place. In this case, the slider 38 has a horizontal abutment surface 39 for engaging over the top beam 13*a* of the heddle frame 6 in order to retain the frame 6 in position.

The vertical arm 15 is formed with a horizontal groove 40 and a vertical groove 41 with a T-shaped cross-section arrangement. The horizontal groove 40 guides the slider 38 by way of a top guide surface 42 and two bottom guide shoulders 43; the vertical groove 41 is disposed in the sectional plane of FIG. 3, extends into the horizontal groove 40 between the shoulders 43 and receives a substantially vertical leaf spring 44 which extends into a bore 45 in the slider 38 and acts thereon in the locking direction.

The slider 38 has a vertical part 46 which is effective as a stop against the pressure of the spring 44 for the locking end position and which enables the slider 38 to be gripped manually and moved outwardly into the release position. Since the groove 40 provides firm guidance of the slider 38, the spring 44 can be disposed slidingly in the bore 45 so that the spring 44 and, therefore, the vertical groove 41 can be short if required.

This arrangement has the advantage that the locking arrangement can be used with a rigid channel-section heddle frame carrier frame, something which is an advantage for some heddle frames. Also, there is no risk of an idle operating heddle frame carrier experiencing increased wear when the loom is in operation.

Figure 4:
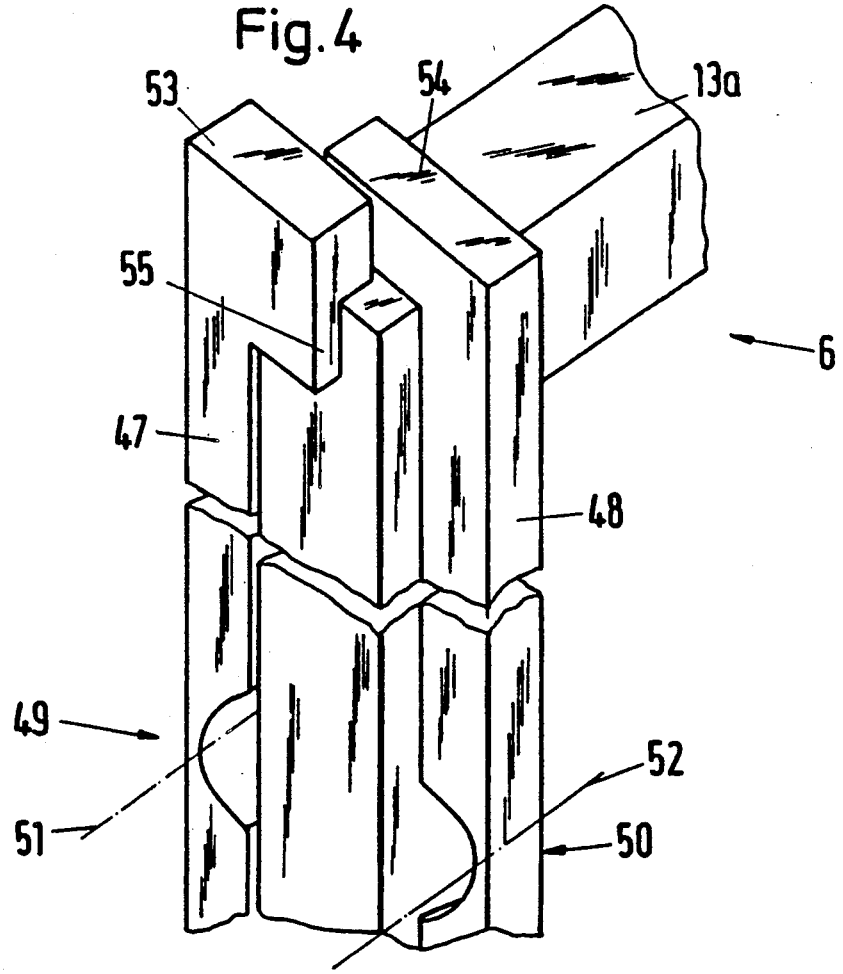
FIG. 4 illustrates perspective view of one side of a heddle frame carrier constructed in accordance with the invention.

FIG. 4 shows one vertical arm 47 of the heddle frame carrier with which another vertical arm 48 co-operates after the fashion of a clamp or grip on the same side of the heddle frame. The other side of the heddle frame carrier is of identical construction and so has been omitted in order not to overload the drawing. Each vertical arm 47, 48 has a resilient reduced zone 49, 50 having a horizontal pivot axis 51, 52 and, at the end of each arm, a rigid locking element 53, 54. This arrangement enables the heddle frame 6 to be engaged around like a clip or gripper, a shoulder 55 on the arm 47 additionally securing the heddle frame 6 horizontally. The arms 47, 48 are interconnected below the reduced zones 49, 50, so that the conventional guiding in the corresponding loom guide 4 is possible.

Advantageously, in this arrangement, the loom guides 4, 5 can be rigid. Also, the spacing between the heddle frames can still be reduced since the vertical arms 47, 48 are offset relative to one another. Thus, the arms 47, 48 of two heddle frames 6, such arms being adjacent one another in the release position, are disposed one beside another and do not strike one another.

The invention thus provides a heddle frame carrier of relatively simple construction which can be used for the interchangeable mounting of heddle frames without the use of tools. Further, the heddle frame is of lightweight construction and occupies a relatively small space within a loom.

The invention further provides a heddle frame carrier which ensures accurate retention of a heddle frame so that loom speeds can be high.

What is claimed is:

1. A heddle frame carrier for retaining an interchangeable heddle frame in a loom, said carrier comprising at least a pair of parallel vertical arms for slidably receiving a heddle frame therebetween, each said arm being sized to permit pivoting of an upper end of one arm away from the other arm; and at least a pair of locking elements, each said locking element being disposed on said upper end of a respective arm for movement therewith between a locking position to engage over a top of a heddle frame and a release position to permit vertical movement of a heddle frame thereby.

2. A heddle frame carrier as set forth in claim 1 wherein each arm has a reduced zone at an intermediate point to form a pivot joint thereat.

3. A heddle frame carrier as set forth in claim 2 which further comprises a horizontal beam extending between said arms to support a heddle frame thereon.

4. A heddle frame carrier as set forth in claim 3 wherein each arm has a vertical prolongation extending below said horizontal beam.

5. A heddle frame carrier as set forth in claim 1 wherein each locking element has a horizontal abutment surface for engaging over a heddle frame and a pair of vertical webs on opposite sides of said abutment surface to retain a heddle frame therebetween.

6. A heddle frame carrier as set forth in claim 5 which further comprises a pair of securing jaws on said horizontal beam for gripping a heddle frame to prevent lateral movement of the heddle frame relative to said beam.

7. A heddle frame carrier as set forth in claim 1 wherein said arms are disposed in offset relation to each other to receive one side of a heddle frame therebetween.

8. A heddle frame carrier for retaining an interchangeable heddle frame in a loom, said carrier comprising a pair of parallel vertical arms for slidably receiving a heddle frame therebetween; and a pair of locking elements, each said locking element being disposed on an upper end of a respective arm for pivoting about a vertical axis between a locking position to engage over a heddle frame and a release position to permit vertical movement of a heddle frame thereby.

9. A heddle frame carrier as set forth in claim 9 wherein each arm has a horizontally disposed bearing surface to support a heddle frame thereon opposite a respective locking element.

10. A heddle frame carrier for retaining an interchangeable heddle frame in a loom, said carrier comprising a pair of parallel vertical arms for slidably receiving a heddle frame therebetween;

at least one slider slidably mounted in one of said arms by means which provide for its sliding for movement between a locking position to engage over a heddle frame and a release position to permit vertical movement of a heddle frame thereby.

11. A heddle frame carrier as set forth in claim 10 wherein said slider includes a vertical stop for abutting a side of said arm and which further comprises a spring biasing said slider into said locking position with said stop abutting said one arm.

* * * * *